US005995056A

United States Patent [19]

Ho et al.

[11] Patent Number: 5,995,056

[45] Date of Patent: Nov. 30, 1999

[54] WIDE BAND TEM FED PHASED ARRAY REFLECTOR ANTENNA

[75] Inventors: Thinh Q. Ho, Anaheim; James C. Logan, San Diego, both of Calif.

[73] Assignee: United States of America as represented by the Secretary of the Navy

[21] Appl. No.: 08/933,437

[22] Filed: Sep. 18, 1997

[51] Int. Cl.[6] ..... H01Q 13/00

[52] U.S. Cl. ..... 343/779; 343/781 CA; 343/840

[58] Field of Search ..... 343/778, 779, 343/781 P, 781 R, 781 CA, 840, 727, 912

[56] References Cited

U.S. PATENT DOCUMENTS

| | | | |
|---|---|---|---|
| 3,742,512 | 6/1973 | Munson | 343/840 |
| 3,815,140 | 6/1974 | Buehler et al. . | |
| 3,816,830 | 6/1974 | Giannini . | |
| 3,878,523 | 4/1975 | Wild . | |
| 3,881,178 | 4/1975 | Hannan . | |
| 4,079,382 | 3/1978 | Henry | 343/753 |
| 4,513,293 | 4/1985 | Stephens . | |
| 4,571,591 | 2/1986 | Valentino et al. . | |
| 5,063,389 | 11/1991 | Reits . | |
| 5,148,182 | 9/1992 | Gautier et al. . | |
| 5,179,386 | 1/1993 | Rudish et al. . | |
| 5,283,587 | 2/1994 | Hirshfield et al. . | |
| 5,365,245 | 11/1994 | Ho . | |
| 5,434,586 | 7/1995 | Kinoshita et al. | 343/840 |

*Primary Examiner*—Don Wong
*Assistant Examiner*—Tan Ho
*Attorney, Agent, or Firm*—Harvey Fendelman; Peter A. Lipovsky; Michael A. Kagan

[57] ABSTRACT

A wide band phased array antenna includes a radio frequency reflector having a focal axis, and first and second sides and an m number of transverse electromagnetic transmission carriers, where each of the carriers includes a first conductor which generally transects the focal axis of the reflector and is electrically connected to a first side of the reflector, and a second conductor electrically connected to a second side of the reflector, where m is a positive integer. The RF reflector is located between the first and second conductors for guiding the beam.

17 Claims, 5 Drawing Sheets

WIDE BAND TEM FED PHASED ARRAY REFLECTOR ANTENNA

BACKGROUND OF THE INVENTION

The present invention relates to the field of antennas, and more particularly, to a phased array antenna employing an electromagnetic reflector and multiple transverse electromagnetic feeds each having a center conductor which generally transects the focal axis of the reflector.

A phased array antenna generally consists of a group of radio frequency energy radiating elements placed in close proximity to each other so that they provide the collective capability to steer an RF beam. The elements may range in size from miniature dipoles to huge parabolic dishes used in radio telescopes, depending on the desired operational characteristics of the antenna. The elements typically are arranged in a regular pattern with a spacing of one-half the wavelength of the RF energy to be received or transmitted by the antenna. If the elements are very close together, they will degrade each other's performance unless special precautions are taken. If they are far apart compared to the wavelength of interest, they cease acting collectively. The amplitude and phase of the input power to each element preferably are established to optimize the beam width, angle of maximum scan, side lobe level, and location of nulls in the radiation pattern of the antenna. The use of a phased array antenna permits the achievement of desirable applications such as the steering of the beam with simple elements with little intrinsic capability.

During the past several years there has been growing interest in developing wide band phased array antennas having a bandwidth of a decade or more. Conventional wide band phased array antenna systems use several antennas, where each antenna contributes a portion of the total operating bandwidth. However, the use of multiple antennas requires significant space, which is a limited resource on board ships or on the tops of buildings, where many antennas are located. Therefore, a need exists for a wide band phased array antenna system which overcomes the aforementioned limitations.

U.S. Pat. No. 3,881,178, "ANTENNA SYSTEM FOR RADIATING MULTIPLE PLANAR BEAMS," describes an antenna system for simultaneously radiating a plurality of planar beams into a region of space. The system includes a cylindrical radio frequency (RF) reflector having a focal axis, and includes feed horns which are oriented perpendicular to the focal axis of the reflector. However, this type of antenna uses feed horns which generate RF signals at a relatively narrow bandwidth. The beam from this antenna can only be steered in perpendicular direction with respect to the focal axis of the reflector in an elevation plane.

DESCRIPTION OF THE DRAWINGS

Throughout the several figures like components are referenced using like reference numbers.

SUMMARY OF THE INVENTION

The present invention provides a wide band phased array antenna includes a radio frequency reflector having a focal axis, and first and second sides and an m number of transverse electromagnetic transmission (TEM) carriers, where each of the carriers includes a first conductor which generally transects the focal axis of the reflector and is electrically connected to a first the reflector, and a second conductor electrically connected to a second side of the reflector, where m is a positive integer. The reflector is oriented between the first and second conductors.

An important advantage of the present invention is that it provides a phased array antenna which may have a wide bandwidth, as for example, of multi-decades. The excellent performance achievable with the invention is due to the use of TEM carriers. Because of the wide bandwidth characteristics of the invention, RF communication systems may employ one antenna embodying various features of the present invention instead of multiple antennas which would otherwise be necessary to cover the same bandwidth. Furthermore, the invention provides high gain across the frequency band. This antenna is expected to find wide application in communications applications, particularly on board ships and buildings, and on communications relay towers.

Another embodiment of the invention is an antenna which includes: a) a phased array antenna having a first radio frequency (RF) reflector; and b) a second, larger RF reflector. The phased array antenna includes the first RF reflector having a focal axis, and first and second sides; and an m number of transverse electromagnetic transmission carriers. Each of the carriers includes a first conductor which generally transects the focal axis of the first reflector and is electrically connected to the first side of the first reflector, and a second conductor electrically connected to the second side of the first reflector, where m is a positive integer. The second radio frequency reflector is positioned so that the transverse electromagnetic transmission carriers of the phased array antenna are positioned between the first and second radio frequency reflectors.

These and other advantages of the invention will become more readily apparent upon review of the following description, taken in conjunction with the accompanying figures and claims.

DESCRIPTION OF THE PREFERRED EMBODIMENT

Figure 1:
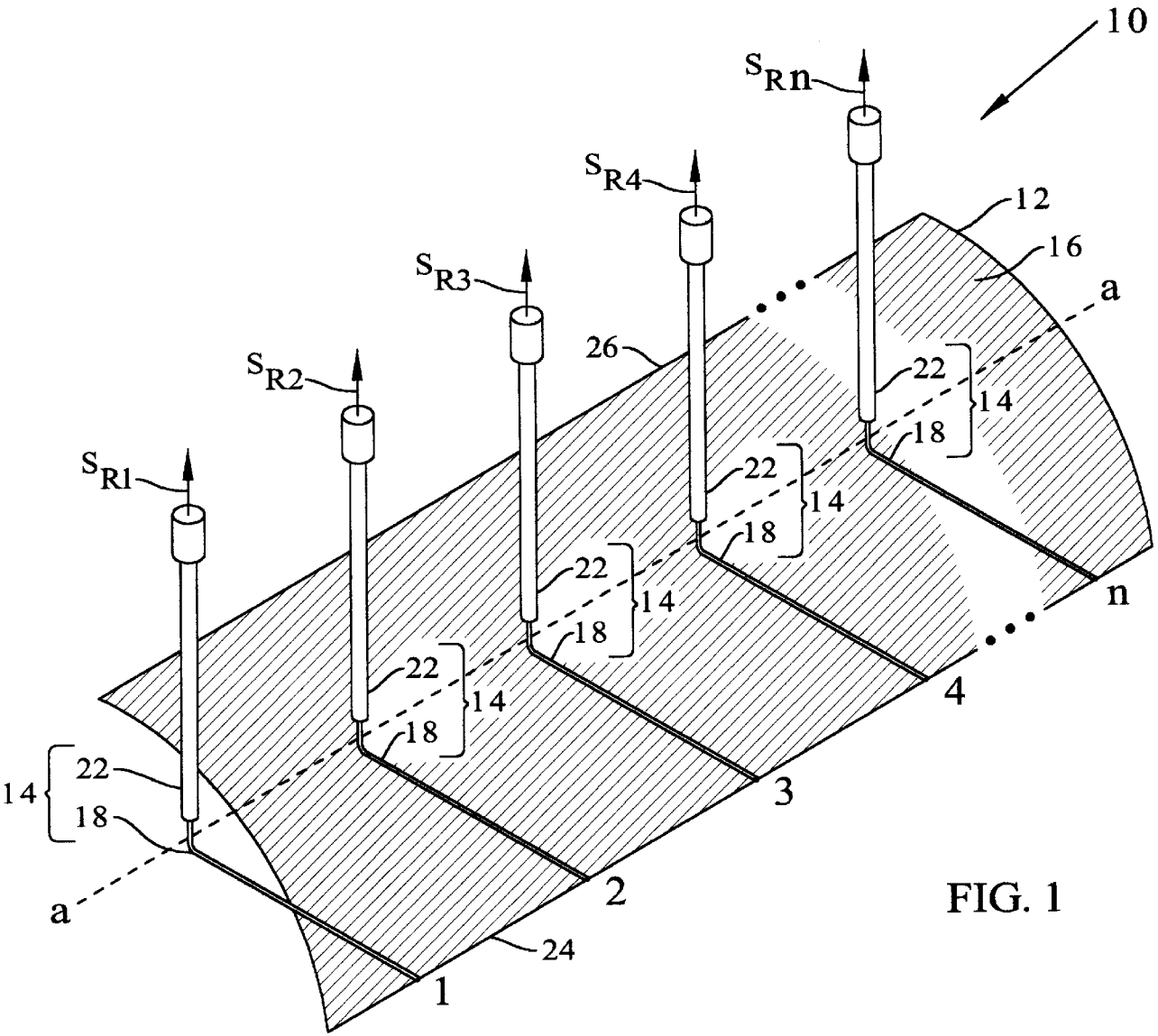
FIG. 1 is a perspective view of a wide band TEM fed phased array reflector antenna embodying various features of the present invention.
Figure 3:
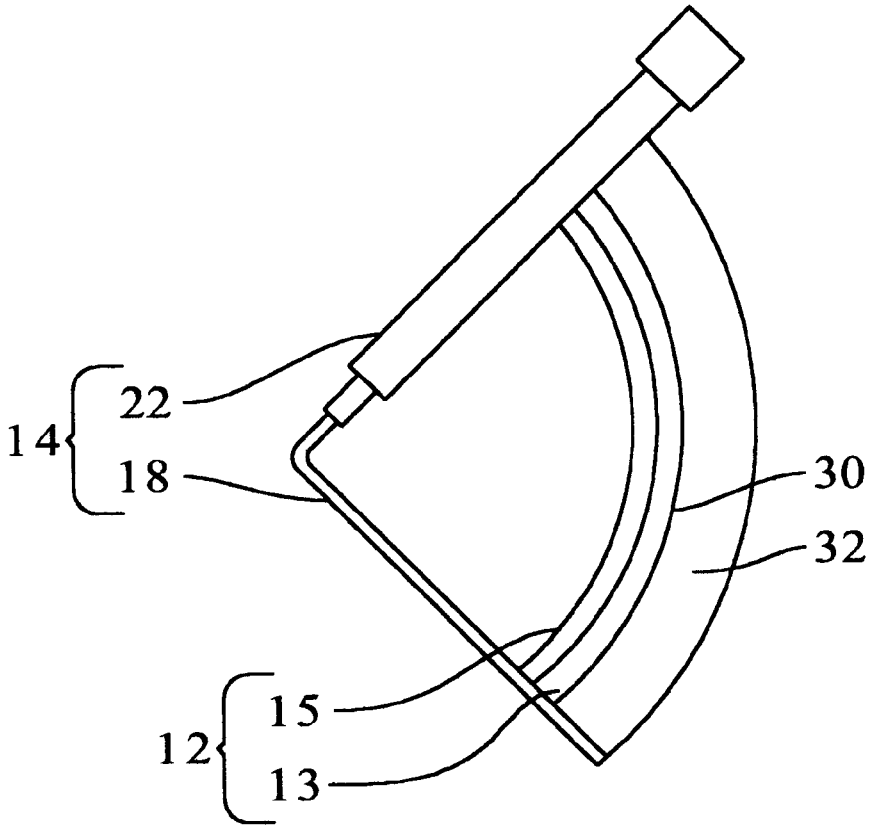
FIG. 3 shows a side view of the antenna of FIG. 1.
Figure 4:
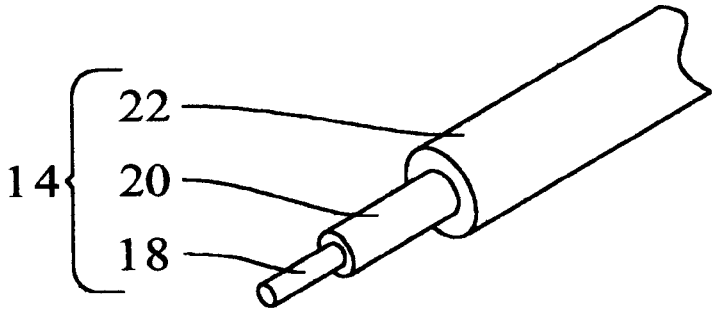
FIG. 4 shows a cut-away view of the coaxial cable used in the antenna system shown in FIG. 1.
Figure 5:
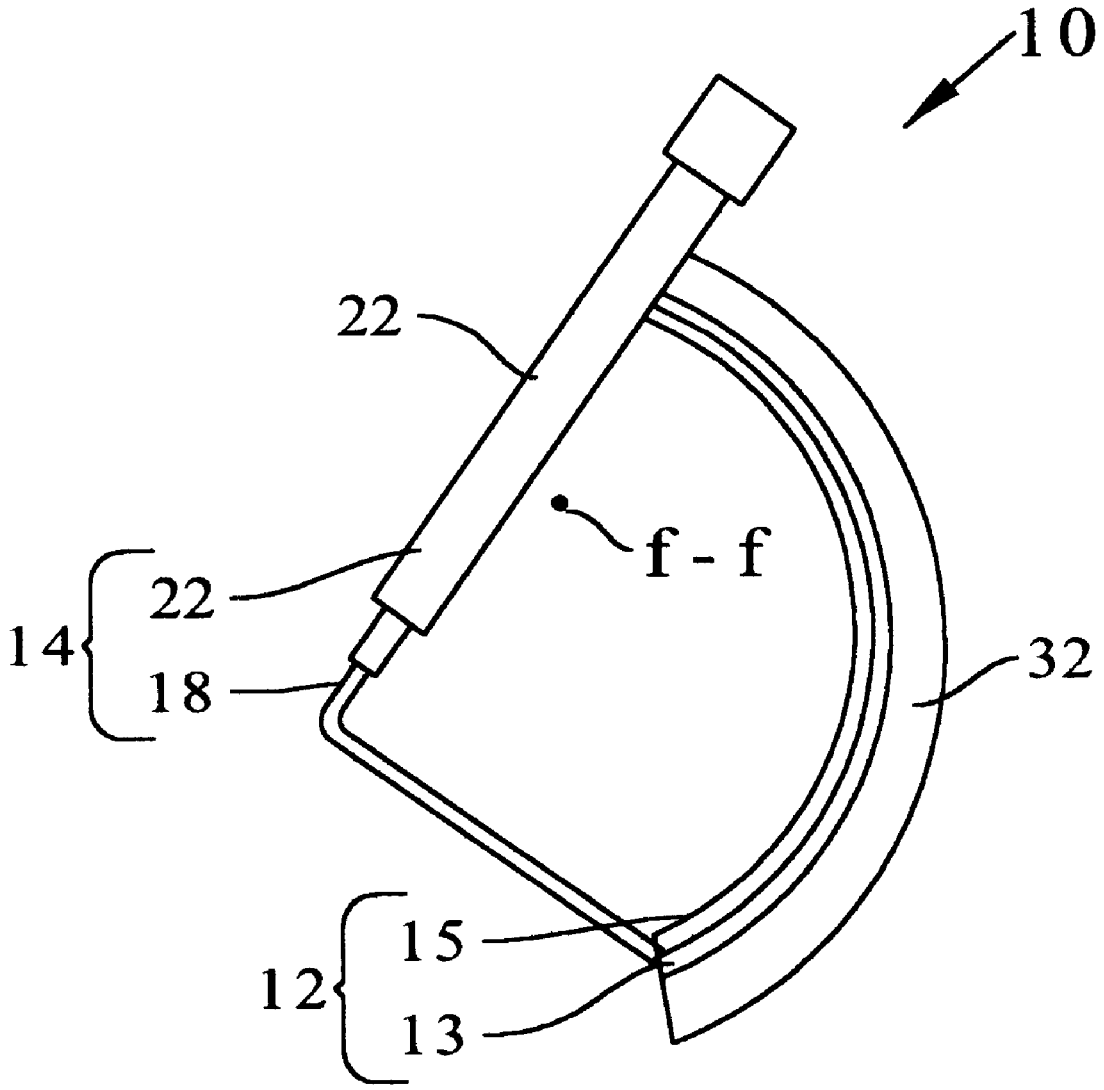
FIG. 5 shows an antenna which the inner conductor of the TEM feed is offset from the focal axis, f—f, of the reflector.

Referring to FIG. 1, there is shown a wide band transverse electromagnetic transmission (TEM) phased array reflector antenna 10 which includes a radio frequency (RF) reflector 12 and an m number of transverse electromagnetic transmission (TEM) carriers 14, where m is a positive integer. The TEM carriers 14 provide excitation RF energy which is reflected off the concave surface 16 of the reflector 12 when the antenna 10 is operated in a transmitting mode, and picks up RF energy reflected off the concave surface 16 when the antenna 10 is operating in a receiving mode. By way of example, the TEM carriers 14 each may have a linear, sinusoidal, or exponential profile. The reflector 12 is shown to have a focal axis a—a, and to be cylindrically shaped. However, it is to be understood that the reflector 12 may have other shapes as well. For example, the reflector 12 may be flat, asymmetrical, or may have a surface shaped as section of an ellipsoid or paraboloid. The TEM carriers 14 may be implemented as coaxial cable having an inner, first conductor 18 surrounded by an insulating sheath 20 (FIG. 4) that is generally "electrically hot." The insulating sheath 20, in turn, is encased in an electrically conductive, second outer sheath 22. In FIGS. 1 and 3, the inner conductor 18 of each TEM carrier 14 is exposed so that it generally transects the focal axis a—a of the reflector to provide the antenna 10 with the best gain and side lobe rejection. However, they may be some applications in which it is desirable for the inner conductor to be exposed such that it does not intersect the focal axis of the reflector 12. In such the case, the inner conductor 18 of TEM carrier 14 is "offset" from the focal axis, f—f, of the reflector 12, as shown in FIG. 5. The inner conductor 18 is electrically connected to edge 24 (FIG. 1) of the reflector 12 at a region generally referred to as a transition region where electrical energy transitions from a form carried by the inner conductor 18 to a form conducted by the electrically conducting concave surface 16 of the reflector 12. The second conductor 22 is electrically connected to the second edge 26 (FIG. 1) of the reflector and generally serves as a ground.

Figure 2:
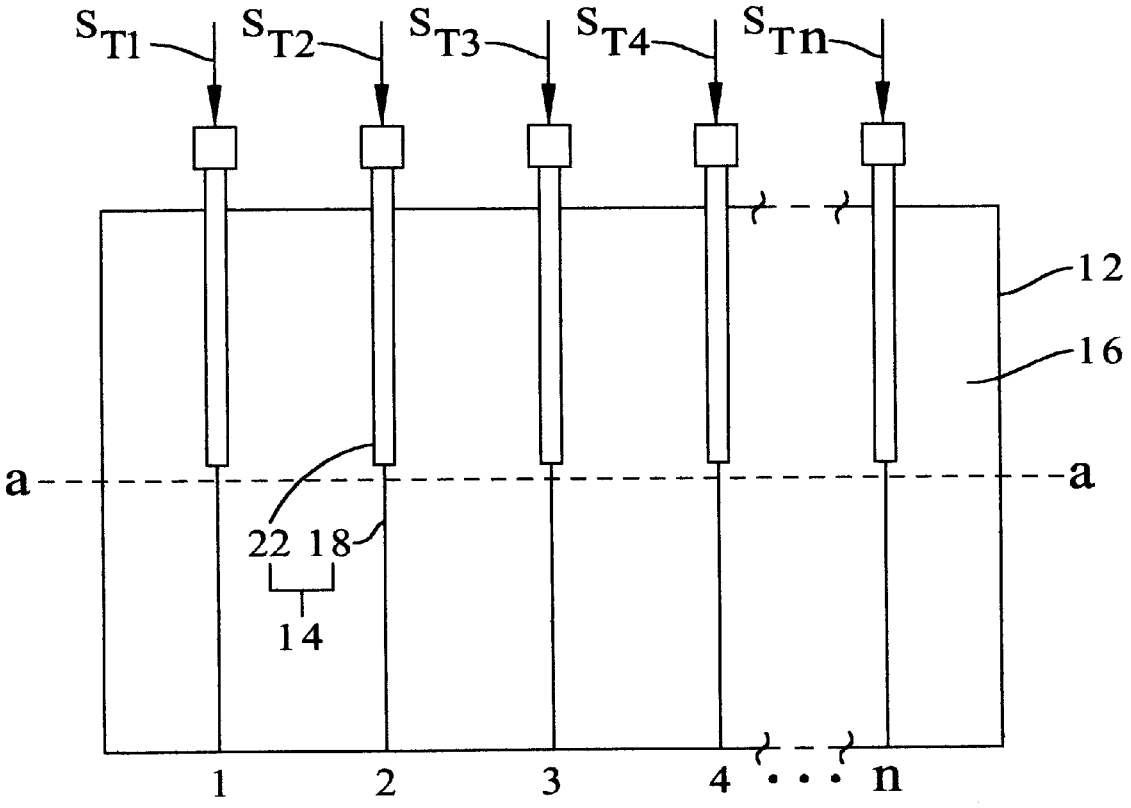
FIG. 2 shows a front view of the antenna of FIG. 1.

In applications where the antenna 10 is used to receive RF energy from a distant source, not shown, RF energy is collected and focused by the reflector onto the exposed inner conductor 18 which transforms RF energy received by the antenna 10 into electrical energy signals $S_{R1}$, $S_{R2}$, $S_{R3}$, $S_{R4}$, . . . $S_{Rn}$, where n is an index, which are conducted by inner conductor 18 to the input of a radio frequency radio receiver 28 (not shown). When the antenna 10 is used in a transmitting mode, as shown in FIG. 2, radio frequency (RF) energy generated by a transmitter (not shown) are conducted as radio frequency signals $S_{T1}$, $S_{T2}$, $S_{T3}$, $S_{T4}$, . . . $S_{Tnt}$ through conductors 18, where they are transformed into RF energy at focal axis a—a and reflect off the concave RF reflecting surface 16 of the reflector 12 so that they radiate to a receiver (not shown).

Referring to FIG. 3, reflector 12 may be made of a fiberglass substrate 13 having a metallized coating 15 mounted on concave surface 16 which may be shaped as a cylinder, or as a region of an ellipsoid, paraboloid, hyperboloid, or any other curved or approximately curved surface having a focal axis. The convex surface 30 of reflector 12 preferably is coated with an electromagnetic absorbent coating 32 such as RAM or RAS, which reduces or eliminates back lobe radiation.

By way of example, the reflector 12 may have a diameter of about 30 includes and an F/D (focal length/diameter) ratio of about 0.375, although the scope of the invention includes the use of other dimensions for the diameter and F/D ratio of the reflector 12.

Figure 6:
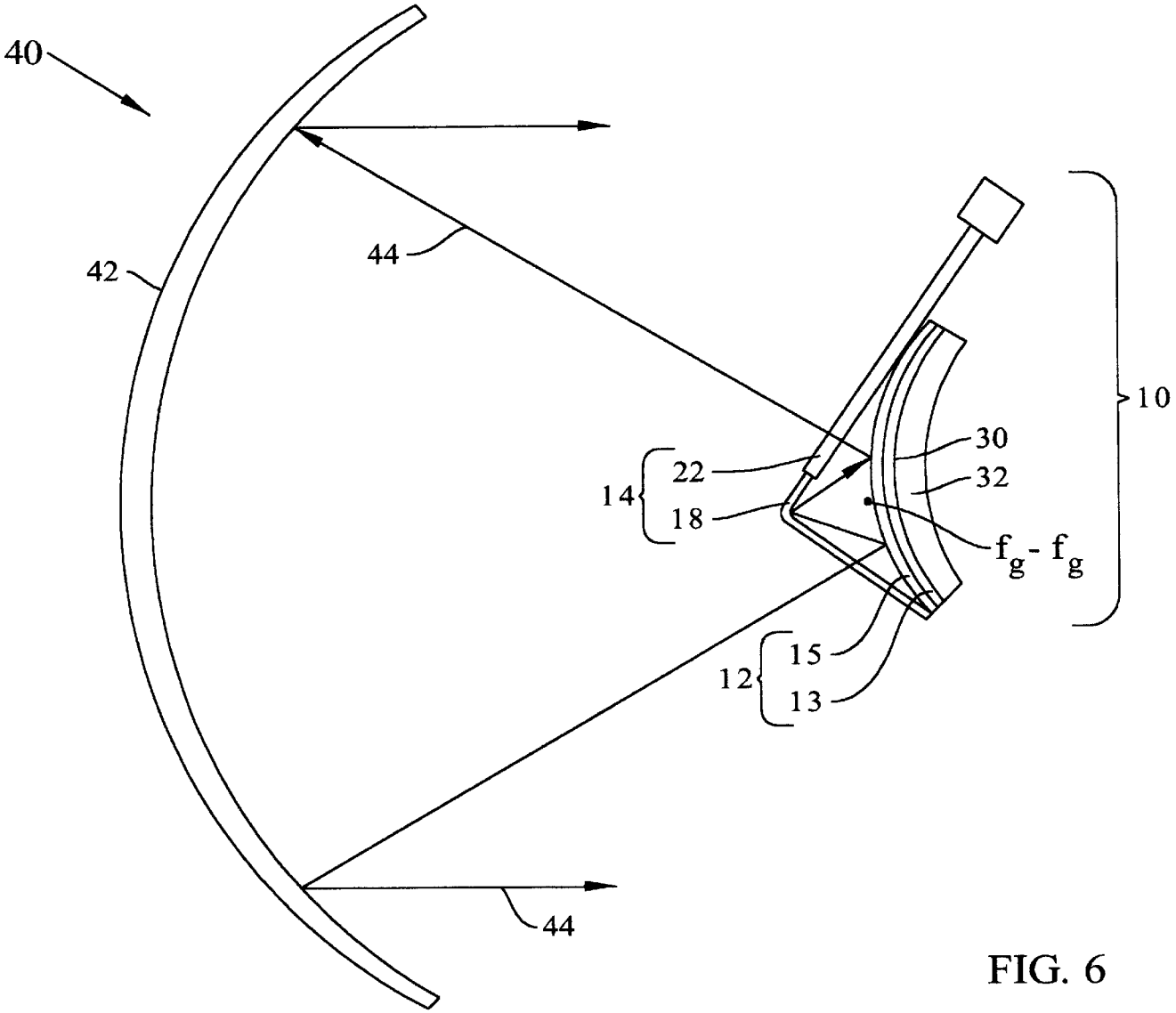
FIG. 6 shows another embodiment of a phased array antenna embodying various features of the present invention.

FIG. 6 shows another embodiment of the invention configured as a Cassegrain-type antenna 40 which includes a wide band transverse electromagnetic transmission (TEM) phased array reflector antenna 10 and RF reflector 42 having, by way of example, a focal axis $f_g$—$f_g$. The reflecting surface 15 of antenna 10, may be positioned substantially along the focal axis, $f_g$—$f_g$ of RF reflector 42 so that RF energy 44 radiating from inner conductor 18 reflects off RF reflecting surface 15 and then is directed to reflect off RF reflector 42. However, the scope of the invention more generally includes a Cassegrain-type antenna in which the TEM carriers 14 are positioned between the RF reflector 42 and the reflector 12, regardless of whether the convex or concave surface of the RF reflector 42 faces phased array antenna 10.

Obviously, many modifications and variations of the present invention are possible in light of the above teachings. It is therefore to be understood that within the scope of the appended claims, the invention may be practiced otherwise than as specifically described.

I claim:

1. A wide band phased array antenna, comprising:

a radio frequency reflector having a focal axis, and first and second sides; and an m number of transverse electromagnetic transmission carriers, where each of said carriers includes a first conductor which generally transects said focal axis of said reflector and is electrically connected to said first side of said reflector, and a second conductor electrically connected to said second side of said reflector, where m is a positive integer and m $\geqq 2$.

2. The antenna of claim 1 wherein each of said first conductors of said electromagnetic transmission carriers generally transect said focal axis at a predetermined location along said focal axis.

3. The antenna of claim 1 wherein said reflector has a cylindrically shaped radio frequency reflecting surface.

4. The antenna of claim 1 wherein said reflector has a surface shaped as a section of a paraboloid.

5. The antenna of claim 1 wherein said reflector has a surface shaped as a section of an ellipsoid.

6. The antenna of claim 1 wherein said reflector has an asymmetrical surface.

7. The antenna of claim 1 wherein transverse electromagnetic transmission carriers have an exponential profile.

8. The antenna of claim 1 wherein transverse electromagnetic transmission carriers have a sinusoidal profile.

9. The antenna of claim 1 wherein transverse electromagnetic transmission carriers have a linear profile.

10. An antenna, comprising:

a wide band phased array antenna which includes:

a first radio frequency reflector having first and second sides; and an m number of transverse electromagnetic transmission carriers, where each of said carriers includes a first conductor electrically connected to said first side of said first radio frequency reflector, and a second conductor electrically connected to said second side of said first radio frequency reflector, where m is a positive integer and m $\geqq 2$; and a second radio frequency reflector having a focal axis and which is positioned so that said transverse electromagnetic transmission carriers generally transect said focal axis and are interposed between said first and second radio frequency reflectors.

11. The antenna of claim 10 wherein each of said first conductors of said electromagnetic transmission carriers generally transect said focal axis at predetermined locations along said focal axis.

12. The antenna of claim 10 wherein said second reflector has a cylindrically shaped radio frequency reflecting surface.

13. The antenna of claim 10 wherein said second reflector has a surface shaped as a section of a paraboloid.

14. The antenna of claim 10 wherein said second reflector has a surface shaped as a section of an ellipsoid.

15. The antenna of claim 10 wherein transverse electromagnetic transmission carriers have an exponential profile.

16. The antenna of claim 10 wherein transverse electromagnetic transmission carriers have a sinusoidal profile.

17. The antenna of claim 10 wherein transverse electromagnetic transmission carriers have a linear profile.

* * * * *